US010233640B1

(12) United States Patent
Russell

(10) Patent No.: US 10,233,640 B1
(45) Date of Patent: Mar. 19, 2019

(54) DROP CEILING ATTACHMENT ASSEMBLY

(71) Applicant: Quicklip LLC, West Palm Beach, FL (US)

(72) Inventor: Clive Russell, West Palm Beach, FL (US)

(73) Assignee: QUICKLIP LLC, West Palm Beach, FL (US)

( * ) Notice: Subject to any disclaimer, the term of this patent is extended or adjusted under 35 U.S.C. 154(b) by 0 days.

(21) Appl. No.: 15/716,833

(22) Filed: Sep. 27, 2017

Related U.S. Application Data

(60) Provisional application No. 62/400,253, filed on Sep. 27, 2016.

(51) Int. Cl.
*E04B 9/18* (2006.01)
*E04B 9/06* (2006.01)
*E04B 9/00* (2006.01)

(52) U.S. Cl.
CPC ..... *E04B 9/18* (2013.01); *E04B 9/006* (2013.01); *E04B 9/067* (2013.01)

(58) Field of Classification Search
CPC . E04B 9/18; E04B 9/006; E04B 9/067; E04B 9/183
USPC ..... 52/39, 220.6, 506.06, 506.07, 506.08; 248/58, 200, 317, 343
See application file for complete search history.

(56) References Cited

U.S. PATENT DOCUMENTS 2,659,807 A * 11/1953 Wakefield ..... E04B 9/34 181/289
3,001,001 A * 9/1961 Bibb ..... E04F 17/08 174/500
3,390,856 A * 7/1968 Van Buren, Jr. ..... E04B 9/16 248/228.3
3,842,561 A * 10/1974 Wong ..... E04B 9/18 248/354.4
4,019,300 A 4/1977 Sauer et al.
4,671,033 A * 6/1987 Smith ..... E04B 9/064 52/220.6
5,979,134 A 11/1999 Neff
6,345,800 B1 * 2/2002 Herst ..... E04B 9/006 248/342
6,637,710 B2 * 10/2003 Yaphe ..... E04B 9/006 248/317
7,506,845 B2 * 3/2009 Oh ..... F16L 3/24 248/72
7,937,903 B2 * 5/2011 McGee ..... E04B 9/02 248/317
7,954,771 B2 * 6/2011 Paulig ..... A62C 35/68 169/16

(Continued)

*Primary Examiner* — Brent W Herring
(74) *Attorney, Agent, or Firm* — Gerry J. Elman; Elman Technology Law, P.C.

(57) ABSTRACT

This assembly solves the problem of hanging heavy implements from a drop ceiling by bypassing its load-bearing capacity. Separate from the drop ceiling track and hangar wires, the user installs an anchor into the structural ceiling, places a rod in the anchor, and attaches to the other end of the rod a track piece formed to fit around the ceiling track. The track piece has two prongs, each with a hole for a screw on the bottom, with the ceiling track passing through the space between the prongs. The user screws a plate or a track for ceiling lights to the bottom of each prong, then attaches the desired hanging implement to the plate or lighting track.

19 Claims, 7 Drawing Sheets

(56) References Cited

U.S. PATENT DOCUMENTS

| | | | | |
|---|---|---|---|---|
| 8,057,077 | B2 * | 11/2011 | Gagne | F21V 21/02 362/147 |
| 8,079,192 | B2 | 12/2011 | Gerkes et al. | |
| 8,889,984 | B2 * | 11/2014 | Korcz | F16M 13/027 174/40 R |
| 9,879,425 | B2 * | 1/2018 | Lachance | E04B 9/18 |
| 2002/0060280 | A1 * | 5/2002 | Yaphe | E04B 9/006 248/317 |
| 2003/0213199 | A1 * | 11/2003 | Bongio | E04B 9/127 52/506.01 |
| 2007/0290101 | A1 * | 12/2007 | Paulig | A62C 35/68 248/75 |
| 2008/0155936 | A1 * | 7/2008 | Miller | E04B 9/18 52/741.1 |
| 2010/0101167 | A1 * | 4/2010 | Morey | E04B 9/183 52/506.06 |
| 2013/0126681 | A1 * | 5/2013 | Greenfield | F16L 3/11 248/62 |
| 2014/0238717 | A1 * | 8/2014 | Korcz | F16M 13/027 174/50 |
| 2014/0353442 | A1 * | 12/2014 | Ye | H02G 3/125 248/200.1 |
| 2015/0308617 | A1 * | 10/2015 | Sareyka | E04B 9/127 52/506.07 |
| 2016/0108615 | A1 * | 4/2016 | Sareyka | E04B 9/127 52/506.05 |
| 2017/0082253 | A1 * | 3/2017 | Sorensen | E04B 9/006 |
| 2017/0167136 | A1 * | 6/2017 | Lachance | E04B 9/18 |

* cited by examiner

DROP CEILING ATTACHMENT ASSEMBLY

CROSS-REFERENCES TO RELATED APPLICATIONS

This application claims priority to U.S. Provisional Patent Application 62/400,253, filed Sep. 27, 2016, which is hereby incorporated by reference.

BACKGROUND OF THE INVENTION

Drop ceilings are ubiquitous for very good reasons. They allow piping and wiring to easily run from room to room without being seen. They allow pipes and wiring to be worked on, installed, or retrofitted without cutting into a building's structural walls or ceilings. Their tiles are light and easy to move when the piping and wiring need to be accessed. Examples of drop ceilings may be found in U.S. Pat. Nos. 4,019,300; 5,979,134; and 8,079,192.

There is one significant drawback, though. The ceiling tiles are held by drop ceiling tracks hung from hangar wires. Typical drop ceiling tracks have an inverted-T-shaped cross section, comprising an upstanding web and generally horizontal flanges extending from the web's base. Due to tiles' light weight, neither the ceiling tracks nor the hangar wires are constructed with the capability to bear much weight. Although this is a significant advantage for working with drop ceilings, the lack of weight capacity makes it difficult to hang anything from a drop ceiling. There is a need for drop ceilings to bear heavier items and implements.

SUMMARY OF THE INVENTION

The invention overcomes the problem of hanging items from a drop ceiling by largely bypassing the ceiling tiles and tracks. Instead, a rod connects to an anchor secured to the structural ceiling. Attached to the lower end of the rod is a track piece designed to fit around the web and flanges of a drop ceiling track. Note that this track piece touches the ceiling track but does not rely on the ceiling track to bear weight. Embodiments of this track piece can produced in various different shapes to accommodate ceiling tracks having different sizes and cross-section shapes. On the bottom of this track piece are bolt holes for detachably securing below it a plate or a track for ceiling lighting. Together with the track piece, the plate or track for ceiling lighting define an aperture or passageway that surrounds a small portion of the ceiling track.

If a plate is used, a hanging implement is attached to the plate. The characteristics of the plate depend on the item to be hung. If the track for ceiling lighting is used instead, ceiling lights are attached to the track. If the track for ceiling lighting is sufficiently long, multiple track piece assemblies may desirably be used along the length of the ceiling lighting track to prevent bending or bowing.

One aspect of the invention is a track piece for use in an assembly for hanging items below a drop ceiling, the track piece comprising a cross piece and a pair of prongs extending downwardly therefrom,

- the cross piece and the pair of prongs surrounding and defining a space for a ceiling track to pass through the track piece,
- each prong having a bolt hole extending from the bottom of the prong substantially upwards into the prong,
- each prong having at least one threaded set screw channel extending from the side of the prong facing away from the space for the ceiling track to the side of the prong facing the aforesaid space, and
- a threaded rod channel extending substantially downwards from the top of the track piece, the rod channel being formed to receive a threaded end of a rod.

Another aspect of the invention is an assembly for hanging items below a drop ceiling, comprising:

- an anchor having two ends, the first end formed to be secured to a member of a structural ceiling, the second end formed with a threaded opening to receive a threaded rod;
- a threaded rod;
- a track piece comprising a cross piece and a pair of prongs extending downwardly therefrom,
  - the cross piece and the pair of prongs surrounding and defining a space for a ceiling track to pass through the track piece,
  - each prong having a bolt hole extending from the bottom of the prong substantially upwards into the prong,
  - each prong having at least one threaded set screw channel extending from the side of the prong facing away from the space for the ceiling track to the side of the prong facing the aforesaid space, and
  - a threaded rod channel extending substantially downwards from the top of the track piece, the rod channel being formed to receive a threaded end of a rod; and
- a plate detachably secured to the track piece and formed to allow implements to be secured thereto, wherein, when the plate is secured to the track piece, the track piece and the plate together surround and define a passageway for the ceiling track to pass through.

Another aspect of the invention is the assembly as described in any aspect above, wherein the plate further has at least one implement opening.

Another aspect of the invention is the assembly as described above, wherein the plate further comprises at least one lip surrounding each implement opening, each lip extending upwards from the plate.

Another aspect of the invention is an assembly for hanging items below a drop ceiling, comprising:

- an anchor having two ends, the first end formed to be secured to a structural ceiling, the second end formed with a threaded opening to receive a threaded rod;
- a threaded rod; and
- a track piece comprising a cross piece and a pair of prongs extending downwardly therefrom,
  - the cross piece and the pair of prongs surrounding and defining a space for a ceiling track to pass through the track piece,
  - each prong having a bolt hole extending from the bottom of the prong substantially upwards into the prong,
  - each prong having at least one threaded set screw channel extending from the side of the prong facing away from the space for the ceiling track to the side of the prong facing the aforesaid space, and
  - a threaded rod channel extending substantially downwards from the top of the track piece, the rod channel being formed to receive a threaded end of a rod;

wherein, when a track for ceiling lighting is secured to the track piece, the track piece and the track for ceiling lighting together surround and define a passageway for the ceiling track to pass through.

Another aspect of the invention is the track piece as described in any aspect above, further comprising an upper portion extending upwards from the cross piece.

Another aspect of the invention is the assembly as described in any aspect above, wherein the threaded rod is a 0.25 inch-20 threaded rod.

Another aspect of the invention is the assembly as described in any aspect above, wherein the threaded rod is a 1.5 inch-6 threaded rod.

Another aspect of the invention is the track piece as described in any aspect above, wherein the track piece further comprises a channel for a wire hangar extending substantially horizontally through the cross piece.

Another aspect of the invention is the track piece as described in any aspect above, further comprising at least one threaded attachment screw channel extending from the side of the track piece into the track piece.

Another aspect of the invention is the track piece as described in any aspect above, wherein the at least one threaded attachment screw channel is a threaded attachment screw channel in each prong extending from the side of the prong facing away from the space for the ceiling track to the side of the prong facing the space for the ceiling track.

Another aspect of the invention is the track piece as described in any aspect above, wherein the at least one threaded attachment screw channel is a threaded attachment screw channel extending through the cross portion, wherein the threaded attachment screw channel extends parallel to the at least one set screw threaded channel.

Another aspect of the invention is a method for installing a drop ceiling attachment assembly to a drop ceiling, the assembly comprising:

an anchor having two ends, the first end being formed to be secured to a structural ceiling, the second end being threaded to receive a rod;

a threaded rod;

a track piece comprising a cross piece and a pair of prongs extending downwardly therefrom, the cross piece and the pair of prongs surrounding and defining a space for a ceiling track to pass through the track piece, each prong having a bolt hole extending from the bottom of the prong substantially upwards into the prong, each prong having at least one threaded set screw channel extending from the side of the prong facing away from the space for the ceiling track to the side of the prong facing the aforesaid space, and a threaded rod channel extending substantially downwards from the top of the track piece, the rod channel being formed to receive a threaded end of a rod; and a plate formed to be attached to the track piece and formed to allow implements to be securely attached thereto, the method comprising:

securing the anchor to the structural ceiling;

screwing the upper end of the threaded rod into the second end of the anchor;

screwing the track piece onto the lower end of the threaded rod;

positioning the track piece and a ceiling track so that the web of the ceiling track passes through the space for the ceiling track of the track piece;

cutting prong holes in at least one ceiling tile to allow the prongs of the track piece to pass through;

placing the at least one ceiling tile on the ceiling track so that the prongs of the track piece pass through the prong holes of the at least one ceiling tile; and bolting the plate to the bottom of the prongs of the track piece.

Another aspect of the invention is the method as described above, further comprising the step of attaching a hanging implement to the plate.

Another aspect of the invention is the method as described in any aspect above, further comprising the step of screwing at least one set screw into the at least one set screw threaded channel in each prong until the at least one set screw contacts the ceiling track.

Another aspect of the invention is the method as described in any aspect above, wherein the plate further comprises at least one implement opening, and further comprising the steps of:

drilling at least one wiring hole in the at least one ceiling tile; and passing at least one wire from the hanging implement through the at least one implement opening and the at least one wiring hole.

Another aspect of the invention is the method as described in any aspect above, wherein the hanging implement is selected from the following: an exit light, an electrical outlet bracket, a smoke detector, a fire sprinkler, a hanging light, a track for curtains, a ceiling fan, a television, a photo plate background bracket, a data post plate bracket, a projector plate, an eye bolt hook, a suspended shelving plate bracket, a Wi-Fi antenna, a Wi-Fi amplifier adapter, and a video camera.

DETAILED DESCRIPTION

Figure 1:
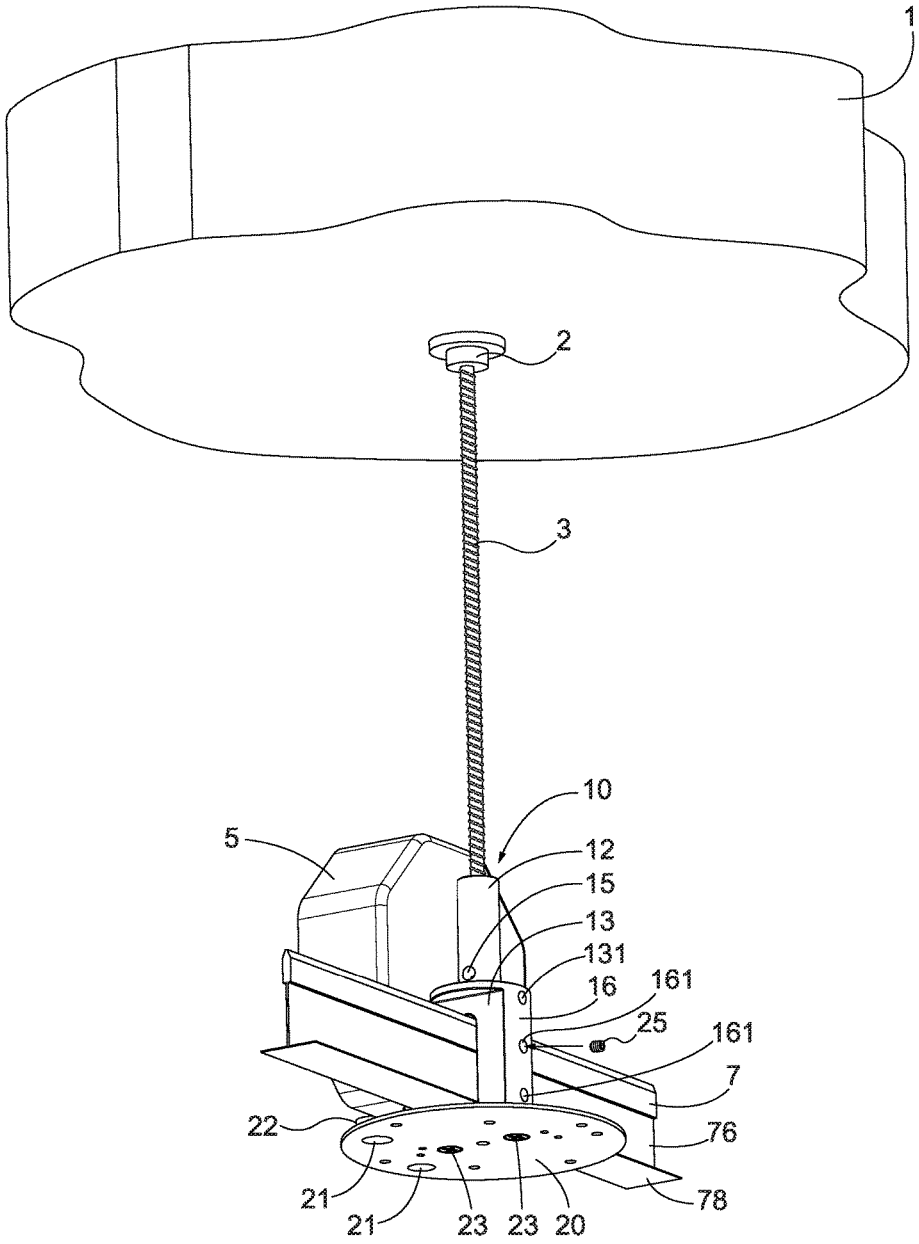
FIG. 1 is an underneath perspective view of an embodiment of the invention before an implement is hung from the plate.

FIG. 1 illustrates a drop ceiling assembly of the present invention. To illustrate the invention without extraneous matter, the ceiling tiles are not shown. A "cutaway" portion of structural ceiling 1 is diagrammatically represented. The structural ceiling may be of concrete, reinforced concrete, wooden beams or underflooring, steel, or other suitable construction material. An anchor 2 is shown. As an example of the various kinds of anchor usable in accordance with the present invention, the anchor 2 has two ends: one end is formed to be driven into or otherwise secured to structural ceiling 1, the other end has a threaded orifice for receiving a threaded rod 3. FIG. 1 shows the anchor 2 having been installed into the structural ceiling 1.

The upper end of the threaded rod 3 has been screwed into the anchor 2. A track piece 10 has been screwed onto the lower end of the threaded rod 3. The track piece 10 has an upper portion 12 adapted for receiving the threaded rod 3. A hole 15 for receiving a wire hangar extends from the front of the upper portion 12 to the back. A portion of a conventional ceiling track 7, an example of which is shown in U.S. Pat. No. 8,590,274, is depicted, having a cross-section generally in the shape of an inverted T, with a web 76 and flanges 78. The portion of ceiling track 7 may be either a main tee or a cross-tee. A set screw 25 is shown to be inserted into the set screw hole 161 to secure the track piece 10 to the web 76 of ceiling track 7.

Attached to the track piece 10 is a plate 20, which may be of aluminum, steel, or other suitable material. The plate 20 is bolted to the underside of the track piece 10 by screws 23. The plate has at least one hole for implements 21, each of which has a lip 22 extending upwards from the rim of the hole for implements 21. An optional electrical box 5 is shown above the plate 20. The electrical box 5 is attached to the track piece 10 through the other end of the channel 131 for the electrical box 5. The point of attachment of the electrical box 5 is not depicted in this figure.

Those skilled in the art will understand that the physical characteristics of threaded rod 3 will depend on the amount of weight the assembly needs to bear. For example, a ¼"-20 threaded rod is useful for bearing weights of about 200 pounds, and a 1.5"-6 threaded rod may be selected for use with weights up to 1000 pounds. Various kinds of threaded rod 3 may be used, as capable of supporting the hanging implement to be attached, i.e., the design weight of the overall assembly. Those skilled in the art will further understand that the choice of anchor 2 depends on the material and construction of the structural ceiling 1 and the characteristics of the chosen threaded rod 3.

Figure 2:
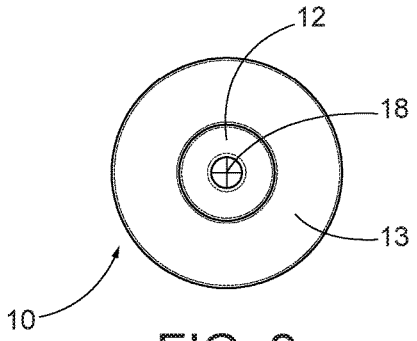
FIG. 2 is a plan view of the preferred embodiment of track piece of the invention.

FIG. 2 shows a plan view of track piece 10. The top of the cross portion 13 of the track piece is depicted, as is the rod hole 18, for receiving an end of a threaded rod. The rod hole 18 is within the upper portion 12 of the track piece 10.

Figure 3:
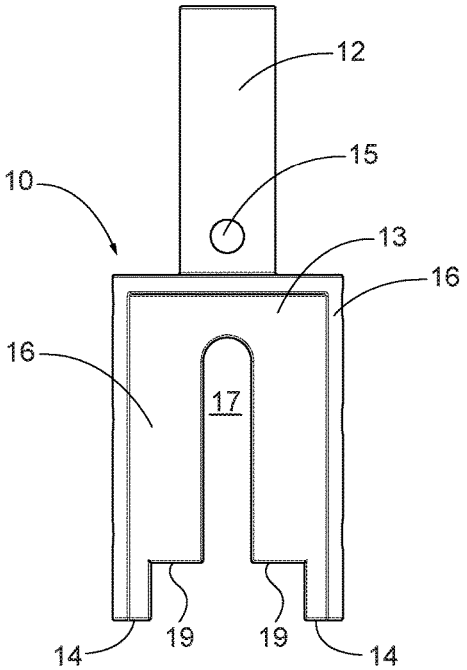
FIG. 3 is an elevation view of the track piece of FIG. 2.
Figure 10:
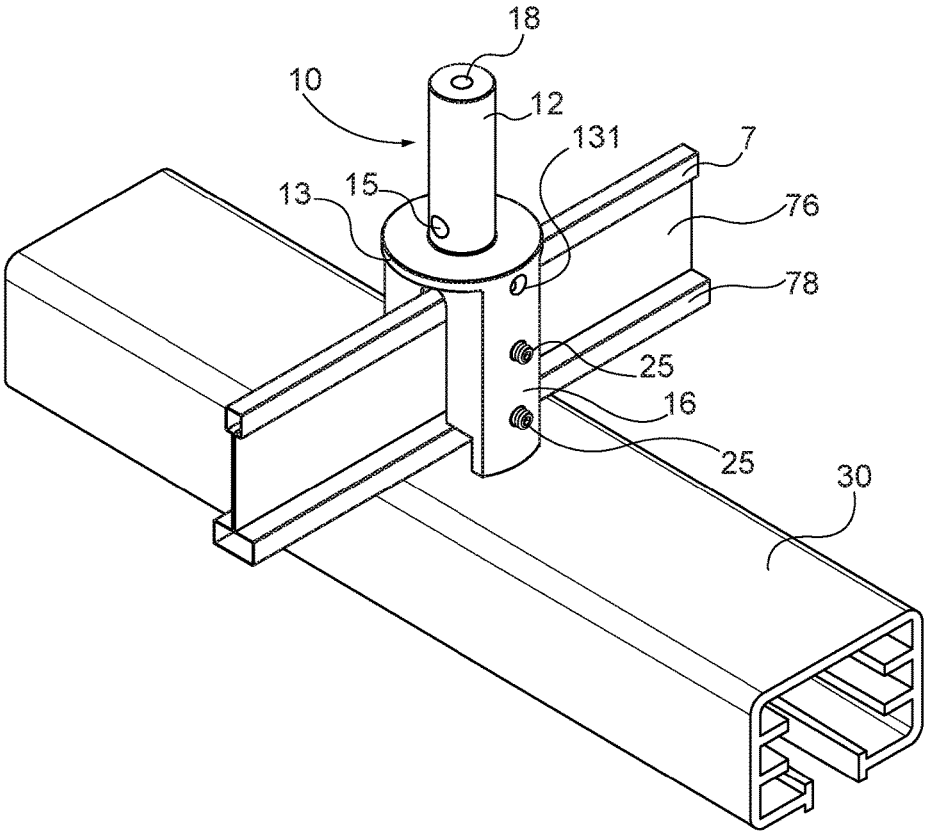
FIG. 10 is a perspective view of a subassembly from an alternative embodiment of the invention, wherein a lighting track has been bolted directly to the track piece.

FIG. 3 shows track piece 10 from the side. The bottom 14 of the prongs 16 are identified in this illustration, as is the cross portion 13 connecting the prongs 16 and the upper portion 12 of the track piece 10. When a plate 20 (as shown in FIG. 1) or a track for ceiling lighting 30 (as shown in FIG. 10) is secured to the bottom 14 of the prongs 16, the combination of the shape of the prongs 16, the space 17 between the prongs 16, the underside 19 of the prongs 16, and the plate 20 or track for ceiling lights 30 define a passageway for the ceiling track 7 (not shown in this figure) to pass through the track piece 10. A hole 15 for a wire hangar is also depicted. It is optional.

Figure 4:
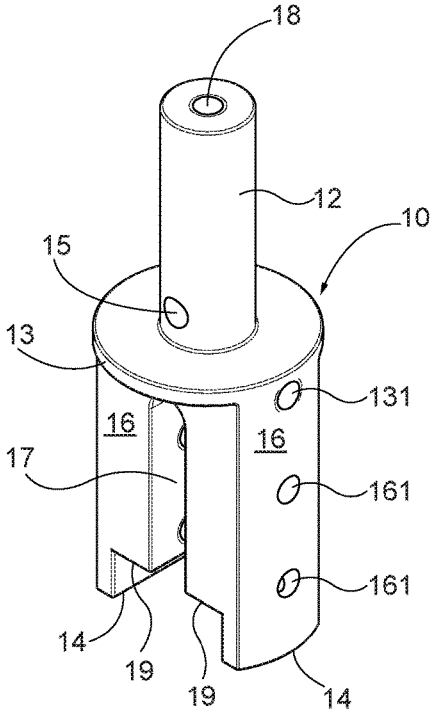
FIG. 4 is an overhead perspective view of the track piece of FIGS. 2 and 3.

FIG. 4 shows a perspective view of the track piece 10. As in FIG. 2, the rod hole 18 is shown within an upper portion 12 of the track piece 10. The cross portion 13 of the track piece connects to two prongs 16. On the outside of each prong 16 are holes for set screws 161. FIG. 4 shows two set screw holes 161, but alternative embodiments may have fewer or more set screw holes 161. Once installed, set screws (not depicted in this drawing) can be inserted into the set screw holes 161 to secure the track piece 10 to the ceiling track 7. The set screws 25 contact the web 76 of the ceiling track 7 for securement.

Each of the set screw holes 161 passes from the outside of its prong 16 to the space 17 between the prongs 16. The space 17 between the prongs 16 defines the volume where a web 76 of a ceiling track 7 will pass through the track piece 10, once the assembly is installed. The bottom 14 of each prong 16 includes a threaded hole (not shown in this figure) for receiving a bolt. The shoulder 19 of the prongs 16, together with the space 17 between the prongs 16, is shaped to fit a common style of ceiling track 7. Once the assembly is installed, the shoulder 19 of the prongs 16 may rest lightly on the flanges 78 of ceiling track 7 (not pictured in this view), and set screws 25 are desirably inserted into the set screw holes 161 to create a snug fit securing track piece 10 to ceiling track 7. A hole 15 for an optional wire hangar is also depicted.

FIG. 4 also depicts a channel 131 for attaching an electrical box or other optional equipment. This channel 131 is threaded to receive a screw. The user will screw through the electrical box 5 (or other optional equipment) into the electrical box channel 131, securing the electrical box 5 (not depicted in this figure) to the track piece 10. In some embodiments, there will be an electrical box channel 131 in each prong, running from the outside of each prong 16 to the space 17 between the prongs 16. In other embodiments, the electrical box channel 131 passes through the cross portion 13 without intersecting the hole 15 for a wire hangar. In such embodiments, the electrical box channel 131 will be placed so as not to intersect with the hole 15 for a wire hangar or the threaded rod channel 18.

Figure 8:
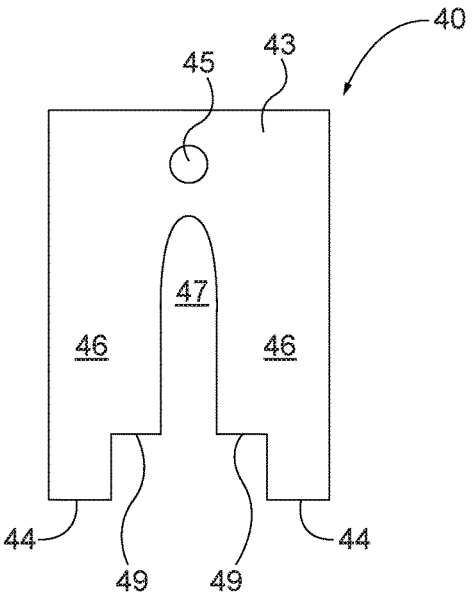
FIG. 8 is an elevation view of an alternative embodiment of a track piece of the invention.

FIG. 8 is an elevation view of an alternative embodiment of the track piece 40. Unlike the embodiment shown in FIGS. 1-4, no upper portion extends from the cross portion 43 of the alternative embodiment of the track piece 40. Instead, the height of the cross portion 43 is greater than in the aforementioned embodiment.

Figure 9:
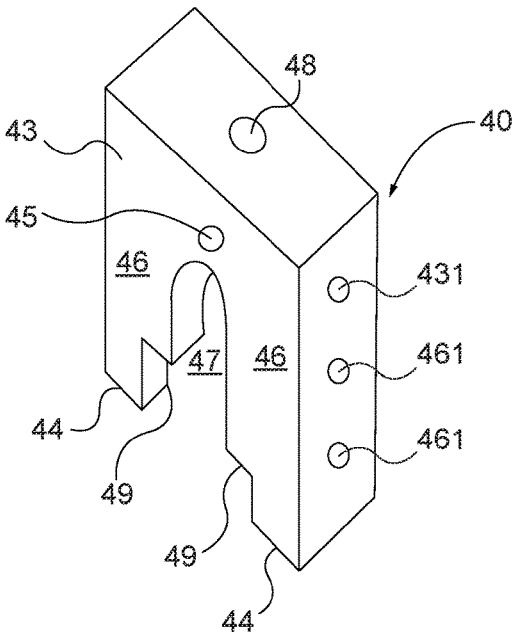
FIG. 9 is an overhead perspective view of the track piece shown in FIG. 8.

FIG. 9 shows an overhead perspective of the same embodiment of the track piece 40 as shown in FIG. 8. FIG. 9 shows that, in this alternative embodiment, the threaded rod 3 is screwed directly into the rod hole 48 on the top of the cross portion 43. As in the embodiment of FIGS. 1-4, when a plate 20 (as shown in FIG. 1) or a track for ceiling lighting 30 (as shown in FIG. 10) is secured to the bottom 44 of the prongs 46, the combination of the shape of the prongs 46, the space 47 between the prongs 46, the underside 49 of the prongs 46, and the plate 20 or track for ceiling lights 30 define a passageway for the ceiling track 7 (not shown in this figure) to pass through the track piece 40. As in the embodiment of FIGS. 1-4, there are set screw holes 461 on the side of each prong 46 facing away from the space between the prongs 47. Furthermore, as shown in the embodiment of FIGS. 1-4, there is a channel 431, desirably threaded, for attaching an electrical box or other optional equipment, e.g., by means of screw 55 shown in FIGS. 5-7. The channel 431 may be constructed to pass through the cross portion 43 (without intersecting the hole 45 for a wire hangar or the threaded rod hole 48). Alternatively, there may be provided a channel 431 in each prong 46 extending from the outside of the prong 46 to the space 47 between the prongs 46.

Those skilled in the art will understand that the shape of the shoulder 19, 49 of the prongs 16, 46 and the space 17, 47 between the prongs 16, 46 would desirably be formed to fit about the particular shape and thickness of various styles of drop ceiling track 7, so as to be useful with a variety of existing drop ceilings Common styles of drop ceiling tracks can be found in the websites and catalogs of home improvement stores and the websites and catalogs of drop ceiling manufacturers, such as ARMSTRONG®. At the time of manufacture, the track piece is formed to accommodate the width of the ceiling track with which the assembly will be used. Common ceiling track widths include 9/16th-inches, 15/16th-inches (sometimes called a 1-inch width), and 1.5-inches. They will further understand that the sizes of the rod hole 18, 48, cross portion 13, 43, and upper portion 12 (if included) are formed to receive the kind of threaded rod 3 being used. As stated above, the choice of threaded rod 3 depends on the amount of weight the assembly is intended to bear.

The track piece 10, 40 may be made of aluminum or steel or other suitable material.

Figure 5:
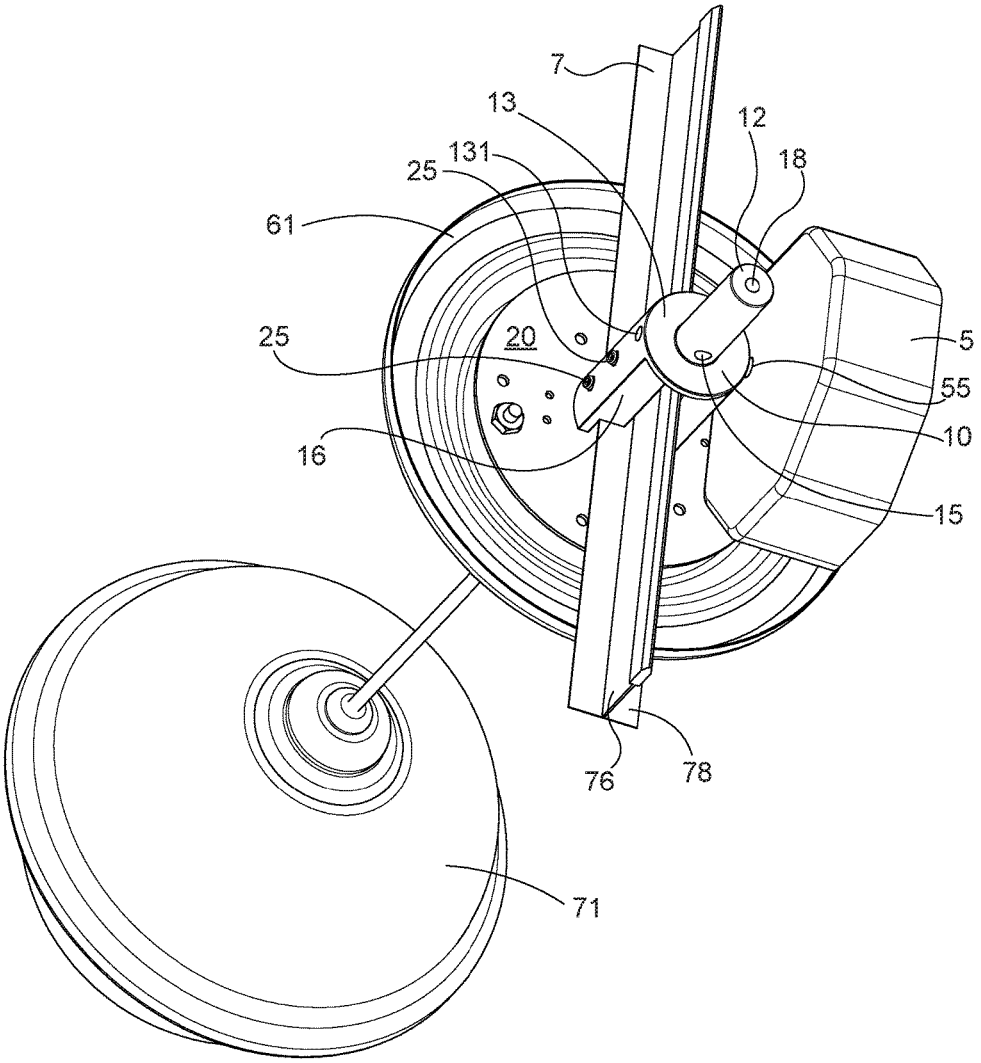
FIG. 5 is an overhead perspective view of an embodiment of the invention incorporating the track piece of FIGS. 2 to 4, wherein a lamp has been hung from the plate.

FIG. 5 shows an overhead perspective view of an installed assembly with a lamp 71 as the hanging implement. To more clearly illustrate the invention, the anchor 2, threaded rod 3, and ceiling tiles are not shown. The upper portion 12, cross portion 13, and rod hole 18 of the track piece 10 are depicted in this illustration. The canopy 61 of the lamp 71 is attached to the plate 20 by conventional means. The lamp 71 hangs below the plate 20 and track piece 10. An electrical box 5 is secured to the plate 20 via a short pipe and nuts (not shown in this figure). The ceiling track 7 passes through the passageway created by the space 17 between the prongs 16 and plate 20. There are set screws 25 in the set screw holes 161 to secure the track piece 10 to the web 76 of ceiling track 7.

The electrical box 5 is attached to the track piece 10 by the screw 55. The screw passes through the electrical box 5, then enters one end of the channel 131 for the electrical box 5. The electrical box 5 is thus secured to the track piece 10. In this figure, the screw 55 is not depicted as protruding through the other end of the channel 131. If the channel 131 passes through the cross portion 13, the screw 55 may optionally extended completely through the channel 131 and protrude out the opposite side.

Figure 6:
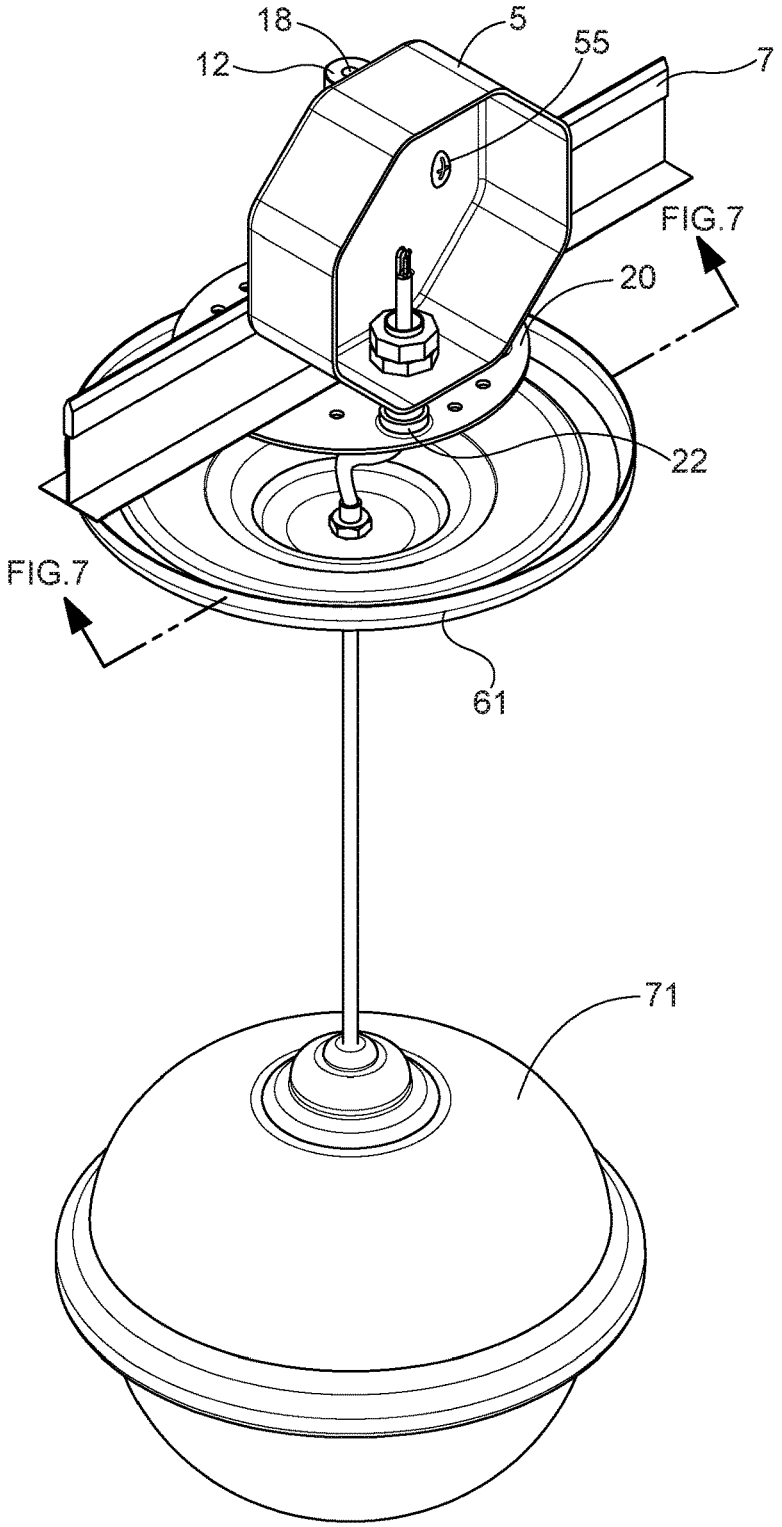
FIG. 6 is a perspective view of the embodiment of FIG. 5 shown from a different viewpoint.

FIG. 6 shows the installed assembly plus lamp of FIG. 5 from a different overhead angle. The wiring for the lamp travels into the electrical box 5 through the plate's implement hole 21 (obscured in this figure by the wiring). In the figure, the upper portion 12 of the track piece 10 is just barely visible, as is the rod hole 18. The figure shows the electrical box 5 being secured to the plate 20 via a short pipe and nuts and to the track piece 10 by screw 55.

Figure 7:
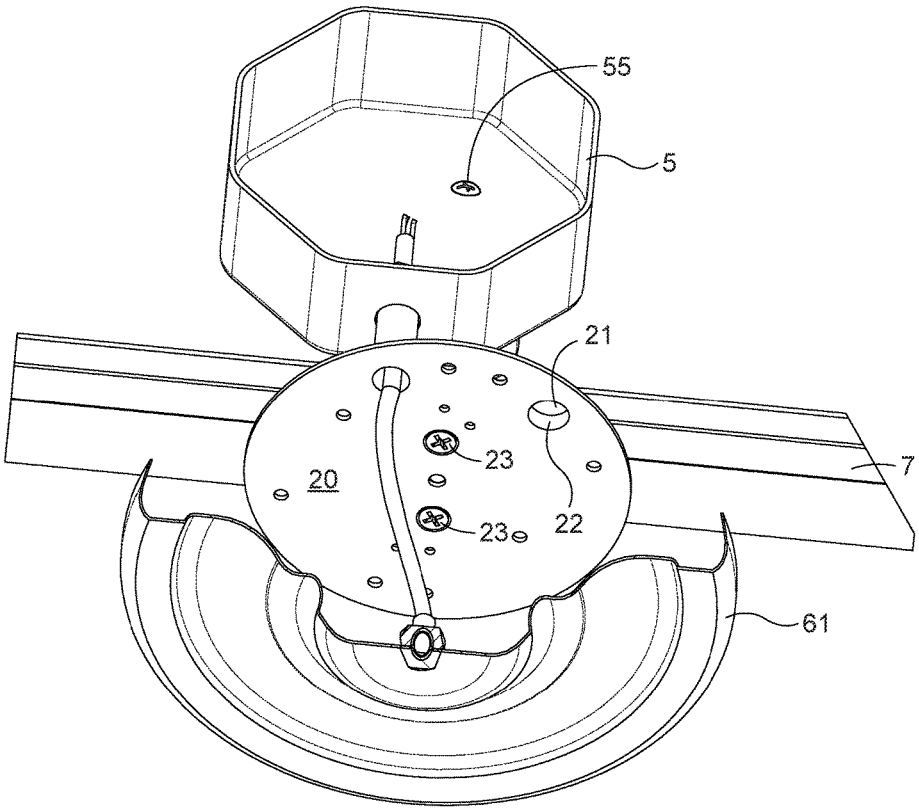
FIG. 7 is a perspective view from underneath, of the embodiment shown in FIG. 6, with the canopy cut away for illustration purposes along the line FIG. 7-FIG. 7.

FIG. 7 shows the installed assembly of FIGS. 5 and 6, with the canopy 61 of the lamp cutaway on the line in FIG. 6 marked FIG. 7-FIG. 7. The plate 20 is bolted by the bolts 23 to the track piece (not pictured in this view). Electric wiring passes from the canopy 61 of the lamp through one of the implement holes 21, up into the electrical box 5. The electrical box 5 is secured to the track piece 10 by screw 55. The ceiling track 7 is also depicted.

Other hanging implements that may desirably be used with the present invention include: an exit light, an electrical outlet bracket, a smoke detector, a fire sprinkler, a hanging light, a track for curtains, a ceiling fan, a television, a photo plate background bracket, a data post plate bracket, a projector plate, an eye bolt hook, a suspended shelving plate bracket, a Wi-Fi antenna, a Wi-Fi amplifier adapter, and a video camera.

FIG. 10 shows an overhead perspective of an alternative embodiment of the invention. To illustrate the invention more clearly, the anchor 2, the rod 3, and the ceiling tiles are not shown in this figure. This figure shows the alternative embodiment being used with the preferred track piece 10 of the invention, but the alternative embodiment of the track piece 40 (shown in FIGS. 8 and 9) may also be used. The upper portion 12 of the track piece 10 extends upwards from the cross portion 13. The rod hole 18 is located at the top of the upper portion 12. The set screw holes 161 on the outside of the prongs 16 are depicted. The set screws 25 pass through the set screw holes 161 to help secure the track piece 10 to the web 76 of the ceiling track 7. As in the preferred embodiment, the ceiling track 7, with its web 76 and flanges 78 (only a portion of which is shown), passes through the track piece 10. The wire hangar hole 15 is also depicted. The electrical box is not depicted in this figure, but the channel 131 for attaching an electrical box (or other optional equipment) is depicted.

In this alternative embodiment, the plate 20 is not used. Instead, a track 30 to hang ceiling lighting is bolted directly to the track piece 10 through the bolt holes on the bottoms 14 of the prongs 16, similar to how the plate 20 is bolted to the track piece 10, as shown in FIG. 7. If the track 30 for ceiling lights is too long for a single assembly, additional assemblies may be installed at other points of the ceiling to assist bearing the weight of the track 30 for ceiling lights.

Installation

To install the drop ceiling assembly, the user installs the anchor 2 into structural ceiling 1. As stated above, the proper anchor 2 must account for the material of the structural ceiling 1, the amount of weight to be hung from the assembly, and the type of threaded rod 3 to be used. The user screws one end of a threaded rod 3 into the threaded end of the anchor 2. The proper threaded rod 3 must account for the amount of weight to be hung from the assembly.

The user screws the track piece 10 onto the lower end of the threaded rod 3. The user positions the track piece 10 and ceiling track 7 so that the web 76 of the ceiling track 7 passes through the space 17 between the prongs 16 of the track piece 10, and so that the horizontal portion 78 of the ceiling track 7 passes under the shoulders 19 of the track piece 10. Optionally, the user may insert set screws 25 into the set screw holes 161 to secure the track piece 10 to the web 76 of the ceiling track 7.

The user cuts holes in the ceiling tiles large enough for the prongs 16 of the track piece 10 to pass through. The user places the ceiling tiles on the ceiling track 7 so that the prongs 16 of the track piece 10 pass through the ceiling tiles. If the hanging implement 71 will need wires or pipes to pass through the ceiling tiles, holes for these wires or pipes will also need to be drilled in the ceiling tiles. The user bolts the plate 20 to the bottom 14 of the prongs of the track piece 10, the bolts 23 passing through the bolt holes on the plate 20 into the threaded holes on the bottom 14 of each prong. The ceiling tiles rest on the flanges 78 of the ceiling track 7, and the plate 20 is below both the flanges 78 of the ceiling track 7 and the ceiling tiles.

The user then attaches the hanging implement 71 to the plate 20. If the hanging implement 71 has wires, cords, or pipes, these should be placed through the additional holes in the ceiling tiles.

In an alternative embodiment of the invention, the user will omit the use of the plate 20. Instead, the user will drill holes into a track 30 for ceiling lights and bolt the track 30 directly to the bottom 14 of the prongs 16 of the track piece 10, then attach the track lights to the track 30 for ceiling lights.

In yet another alternative embodiment of the invention, the user omits the use of the anchor 2 and threaded rod 3. Instead, the user will use a conventional wire hangar, similar to that used to hang the ceiling track 7. The user will attach the track piece 10, 40 to the wire hangar through the track piece's hole 15, 45 for the wire hangar. The track piece 10, 40 will then hang from the wire hangar. As in the preferred embodiment, the plate 20 is bolted to the track piece 10, 40, and the hanging implement 71 is attached to the plate 20.

Those skilled in the art will understand that the installation steps listed above may done in different order. For example, the holes in the ceiling tiles may be cut before any other steps are taken, or the track piece 10, 40 may be screwed onto the lower end of the threaded rod 3 before the rod 3 is screwed into the anchor 2.

Those skilled in the art will further understand that an existing drop ceiling may be retrofitted to accommodate the assembly, or instead, that the assembly may be installed at the same time a new drop ceiling is installed.

I claim:

1. A track piece for use in an assembly for hanging an item from a structural ceiling so that the item is positioned below a drop ceiling, the track piece comprising a cross piece and a pair of prongs extending downwardly therefrom, the cross piece and the pair of prongs being unitarily formed;

the cross piece and the pair of prongs surrounding and defining a space for a ceiling track to pass through the track piece, each prong having a bolt hole extending from the bottom of the prong substantially upwards into the prong, each prong having at least one threaded set screw channel extending from the side of the prong facing away from the space for the ceiling track to the side of the prong facing the aforesaid space, and a threaded rod channel extending substantially downwards from the top of the track piece, the rod channel being formed to receive a threaded end of a rod, wherein, when the assembly is installed, the track piece transfers the weight of the assembly and the item through the rod channel to the rod, which transfers the weight to an anchor secured to the structural ceiling.

2. The track piece of claim 1, further comprising an upper portion extending upwards from the cross piece, the upper portion being unitarily formed with the cross piece and the pair of prongs.

3. The track piece of claim 1, wherein the track piece further comprises a channel for a wire hangar extending substantially horizontally through the cross piece.

4. The track piece of claim 1, further comprising at least one threaded attachment screw channel extending from the side of the track piece into the track piece.

5. The track piece of claim 4, wherein the at least one threaded attachment screw channel is a threaded attachment screw channel in each prong extending from the side of the prong facing away from the space for the ceiling track to the side of the prong facing the space for the ceiling track.

6. The track piece of claim 4, wherein the at least one threaded attachment screw channel is a threaded attachment screw channel extending through the cross portion, wherein the threaded attachment screw channel extends parallel to the at least one set screw threaded channel.

7. An assembly for hanging an item from a structural ceiling so that the item is positioned below a drop ceiling, comprising:

an anchor having two ends, the first end formed to be secured to a member of a structural ceiling, the second end formed with a threaded opening to receive a threaded rod;

a track piece comprising a cross piece and a pair of prongs extending downwardly therefrom, the cross piece and the pair of prongs being unitarily formed;

the cross piece and the pair of prongs surrounding and defining a space for a ceiling track to pass through the track piece, each prong having a bolt hole extending from the bottom of the prong substantially upwards into the prong, each prong having at least one threaded set screw channel extending from the side of the prong facing away from the space for the ceiling track to the side of the prong facing the aforesaid space, and a threaded rod channel extending substantially downwards from the top of the track piece, the rod channel being formed to receive a threaded end of a rod;

an attachment piece detachably secured to the track piece and formed to allow implements to be secured thereto, the attachment piece being selected from the following: a plate and a track for ceiling lighting;

an item attached to the attachment piece; and a threaded rod having an upper end and a lower end, the threaded rod positioned so that the upper end mates with the second end of the anchor and the lower end mates with the threaded rod channel of the track piece;

wherein, when the attachment piece is secured to the track piece, the track piece and the attachment piece together surround and define a passageway for the ceiling track to pass through, and wherein, when the assembly is installed and the item is attached to the attachment piece, the track piece transfers the weight of the assembly and the item through the rod channel to the rod, which transfers the weight to the anchor secured to the structural ceiling.

8. The assembly of claim 7, wherein the attachment piece is the plate, the plate further has at least one implement opening.

9. The assembly of claim 8, wherein the plate further comprises at least one lip surrounding each implement opening, each lip extending upwards from the plate.

10. The assembly of claim 8, wherein the threaded rod is selected from the following: a 0.25 inch-20 threaded rod and a 1.5 inch-6 threaded rod.

11. The assembly of claim 7, wherein the threaded rod is selected from the following: a 0.25 inch-20 threaded rod and a 1.5 inch-6 threaded rod.

12. The assembly of claim 7, wherein the track piece further comprises an upper portion extending upwards from the cross piece, the upper portion being unitarily formed with the cross piece and the pair of prongs.

13. The assembly of claim 12, wherein the attachment piece is the plate, the plate further having at least one implement opening.

14. The assembly of claim 13, wherein the plate further comprises at least one lip surrounding each implement opening, each lip extending upwards from the plate.

15. The assembly of claim 12, wherein the threaded rod is selected from the following: a 0.25 inch-20 threaded rod and a 1.5 inch-6 threaded rod.

16. A method for using an assembly to hang an item from a structural ceiling so that the item is positioned below a drop ceiling, the assembly comprising:

an anchor having two ends, the first end being formed to be secured to a structural ceiling, the second end being threaded to receive a rod;

a threaded rod having an upper end and a lower end;

a track piece comprising a cross piece and a pair of prongs extending downwardly therefrom, the cross piece and the pair of prongs being unitarily formed;

the cross piece and the pair of prongs surrounding and defining a space for a ceiling track to pass through the track piece, each prong having a bolt hole extending from the bottom of the prong substantially upwards into the prong, each prong having at least one threaded set screw channel extending from the side of the prong facing away from the space for the ceiling track to the side of the prong facing the aforesaid space, and a threaded rod channel extending substantially downwards from the top of the track piece, the rod channel being formed to receive a threaded end of a rod; and a plate formed to be attached to the track piece and formed to allow implements to be securely attached thereto, the method comprising:

securing the anchor to the structural ceiling;

screwing the upper end of the threaded rod into the second end of the anchor;

screwing the track piece onto the lower end of the threaded rod;

positioning the track piece and a ceiling track so that the web of the ceiling track passes through the space for the ceiling track of the track piece;

cutting prong holes in at least one ceiling tile to allow the prongs of the track piece to pass through;

placing the at least one ceiling tile on the ceiling track so that the prongs of the track piece pass through the prong holes of the at least one ceiling tile;

bolting the plate to the bottom of each prong of the track piece, and attaching the item to the plate, wherein, when the assembly is installed and the item is attached to the plate, the track piece transfers the weight of the assembly and the item through the rod channel to the rod, which transfers the weight to the anchor secured to the structural ceiling.

17. The method of claim 16, wherein the item is selected from the following: an exit light, an electrical outlet bracket, a smoke detector, a fire sprinkler, a hanging light, a track for curtains, a ceiling fan, a television, a photo plate background bracket, a data post plate bracket, a projector plate, an eye bolt hook, a suspended shelving plate bracket, a Wi-Fi antenna, a Wi-Fi amplifier adapter, and a video camera.

18. The method of claim 16, wherein the plate further comprises at least one implement opening, and further comprising the steps of:

drilling at least one wiring hole in the at least one ceiling tile; and passing at least one wire from the hanging implement through the at least one implement opening and the at least one wiring hole.

19. The method of claim 16, further comprising the step of screwing at least one set screw into the at least one set screw threaded channel in each prong until the at least one set screw contacts the ceiling track.

* * * * *